United States Patent [19]

Miura et al.

[11] Patent Number: 4,854,754

[45] Date of Patent: Aug. 8, 1989

[54] RECORDING APPARATUS

[75] Inventors: Kunihiko Miura, Hiratsuka; Takefumi Nosaki, Yokohama, both of Japan

[73] Assignee: Kabushiki Kaisha Toshiba, Kanagawa, Japan

[21] Appl. No.: 7,792

[22] Filed: Jan. 28, 1987

[30] Foreign Application Priority Data

Jan. 31, 1986 [JP] Japan ..... 61-19725

[51] Int. Cl.[4] ..... B41J 31/14; B41J 31/00

[52] U.S. Cl. ..... 400/802.2; 400/120; 400/210; 346/140 R; 346/1.1

[58] Field of Search ..... 400/126, 174, 210; 346/76 PH, 140 PD, 140 R, 1.1

[56] References Cited

U.S. PATENT DOCUMENTS

| | | | |
|---|---|---|---|
| 3,834,301 | 9/1974 | Croquelois et al. | 400/126 X |
| 4,630,075 | 12/1906 | Hori | 400/126 X |
| 4,631,597 | 12/1986 | Cooke et al. | 400/126 X |
| 4,651,175 | 3/1987 | Tazaki | 400/126 X |
| 4,682,182 | 7/1987 | Oyama et al. | 400/126 X |
| 4,731,619 | 3/1988 | Miura et al. | 346/140 PD X |
| 4,733,254 | 3/1988 | Yukihiro et al. | 346/140 PD |
| 4,740,801 | 4/1988 | Shimazaki | 346/140 PD |
| 4,746,930 | 5/1988 | Shimazaki et al. | 346/140 PD X |

FOREIGN PATENT DOCUMENTS

| | | | |
|---|---|---|---|
| 131882 | 10/1980 | Japan | 400/126 |
| 60-71260 | 4/1985 | Japan . | |

*Primary Examiner*—Edgar S. Burr
*Assistant Examiner*—James R. McDaniel
*Attorney, Agent, or Firm*—Finnegan, Henderson, Farabow, Garrett, & Dunner

[57] ABSTRACT

A recording apparatus according to the present invention records data on a member to be recorded by filling recording ink in a film having numerous minute orifices and by heating the ink rapidly with heating elements to spout ink from the orifices on the member to be recorded by means of the pressure of bubbles generated. The present recording apparatus further comprises a printing data control circuit for controlling the drive of the heating elements according to a recorded data. The printing data control circuit includes a plural printing control circuit for controlling the same heating elements to be driven for a plural number of times in accordance with a plural number printing control signal.

9 Claims, 25 Drawing Sheets

4-BIT COUNTER
DECODER
A/D CONVERTER
TIMER
I/O PORTS
V DATA
LATCH
VCLK
HEUB
HM
(S22)
(S20)
(S21)
+5V
R29
R30
R31
S27
S28
PSYNC
HSYNC
V CLK
V DATA
(INT3)
(INT1)
(INT2)
CLKA
DATA ADR
CONT
251
253
255
257
259
261
263
264
265
267
269
271
273

FIG. 19

| ABBREVIATION FOR COMMAND | FUNCTION |
|---|---|
| SR 1 | STATUS 1 DEMAND |
| SR 2 | STATUS 2 DEMAND |
| SEL ON | SELECT LAMP ON |
| SEL OFF | SELECT LAMP OFF |
| PSEL | PRINT MODE SELECT |
| IDSEL | IMAGE DENSITY SELECT |

FIG.20

| | DATA 8 | DATA 7 | DATA 6 | DATA 5 | DATA 4 | DATA 3 | DATA 2 | DATA 1 |
|---|---|---|---|---|---|---|---|---|
| SR 1 | COMMAND | CELECT SW ON | READY | DENSITY (HIGH) | IMAGE | CASSETTE SIZE (3 BIT) | | |
| SR 2 | | NO PAPER | PAPER JAM | COVER OPEN | NO INK | | | |

SPEED-TORQUE CHARACTERISTIC CURVE

RECORDING APPARATUS

BACKGROUND OF THE INVENTION

1. Field of the Invention

The present invention relates to a nonimpact type recording apparatus which carries out recording by rapidly heating, with heating elements, a moving film that has numerous ink-filled pores, and by jetting out ink within numerous pores by means of the pressure of bubbles that are generated in heating.

2. Description of the Prior Art

As an impact type recording apparatus, there is known the ink jet type apparatus (ink jet printer).

The ink jet printer carries out printing by jetting out ink that is filled in nozzles on a recording paper by the distorting force due to piezoelectric element, electrostatic force, or the like. While the ink jet printer has excellent aspects such as quietness, low power, ease in miniaturization, and so on, the nozzles tend to be blinded so that it has not yet succeeded in gaining reliability.

Then, there has been proposed a new recording apparatus which eliminates the drawbacks that existed in the prior-art ink jet printer (see Japanese Pat. No. 60-71260).

This recording apparatus uses a film that has, instead of orifices nozzles, a multi-orifice portion that is formed by a multitude of diameter 10 to 200 um. Ink is filled in numerous orifices, and the ink-filled multi-orifice portion is heated rapidly with heating elements, and recording is carried out by letting ink in the numerous orifices gushing on a recording paper by means of the pressure of bubbles that are generated.

Now, although the apparatus proposed is able to eliminate the problem of blinding of nozzles, while maintaining the advantageous aspects of the jet ink printer, it has such a problem as the generation of a less clear printing, particularly in the middle density portion since the apparatus does not have a function for adjusting most suitably the print density in accordance with the printed pattern and the size of the member to be recorded. This results in an irregular printing.

SUMMARY OF THE INVENTION

An object of the present invention is to provide a recording apparatus which is capable of maintaining the clear print.

Another object of the present invention is to provide a recording apparatus which can prevent the generation of the irregular printing.

Another object of the present invention is to provide a recording apparatus which can drive the same heating elements for a plural number of times to accomplish the plural number printing.

A feature of the present invention is that in a recording apparatus which records data on a member to be recorded by filling recording ink in a film having numerous minute orifices and by heating the ink rapidly with heating elements to spout ink from the orifices on the member to be recorded by means of the pressure of bubbles generated, the present recording apparatus further comprises a printing data control circuit for controlling the drive of the heating elements according to a recorded data. The printing data control circuit includes a plural printing control circuit for controlling the same heating elements to be driven for a plural number of times in accordance with a plural number printing control signal.

These and other objects, features and advantages of the present invention will be more apparent from the following description of a preferred embodiment, taken in conjunction with the accompanying drawings.

BRIEF DESCRIPTION OF THE DRAWINGS

FIG. 19 is a diagram which shows the various kinds of command that are sent out from the printer interface;

FIG. 20 is a diagram which shows the status of the print control unit;

DESCRIPTION OF THE PREFERRED EMBODIMENTS

Figure 1:
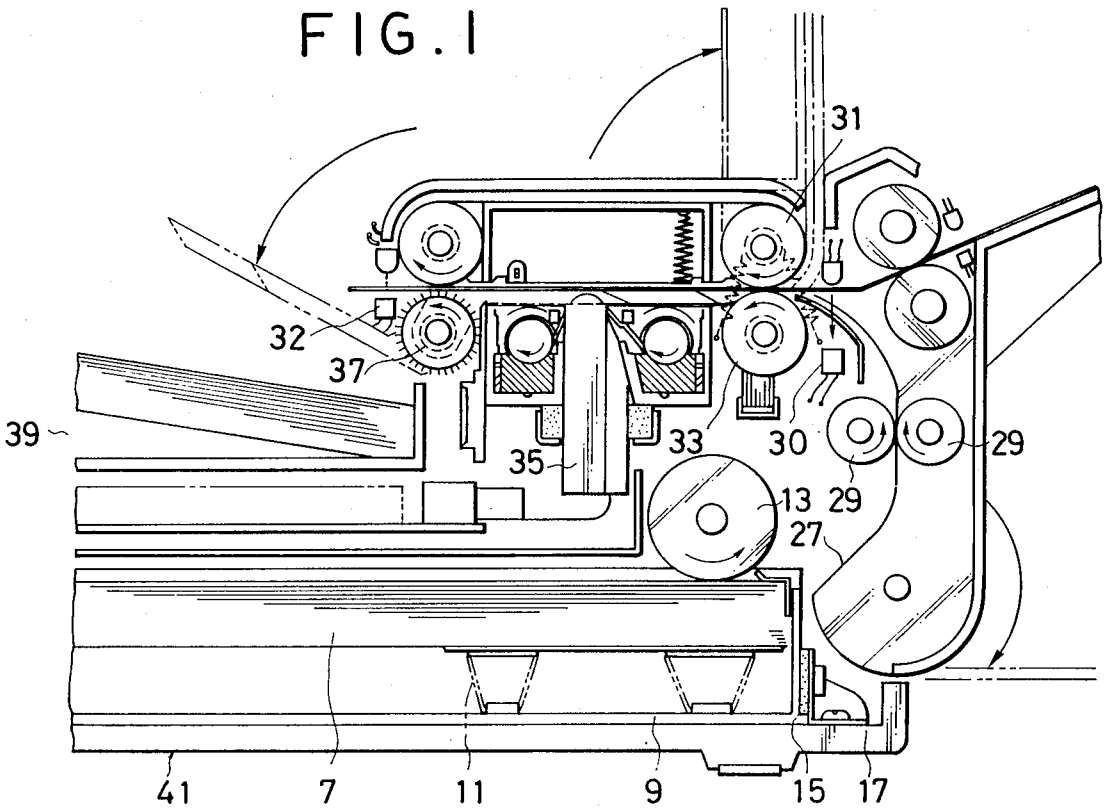
FIG. 1 and FIG. 2 are a side view and a front view which show the overall configuration of the recording apparatus in accordance with the present invention.

Referring to FIG. 1, there is shown a recording apparatus embodying the present invention.

As shown in FIG. 1, a recording paper (member to be recorded) 7 is housed in a cassette 9, and is pushed upward by a pushing-up springs 11 to make a contact with a feed roller 13. On the cassette 9 there is provided a claw 15 for discriminating the size which turns on a cassette discrimination switch 17. In this way, the cassette size (of A4, B5, and so on) is discriminated.

Figure 2:
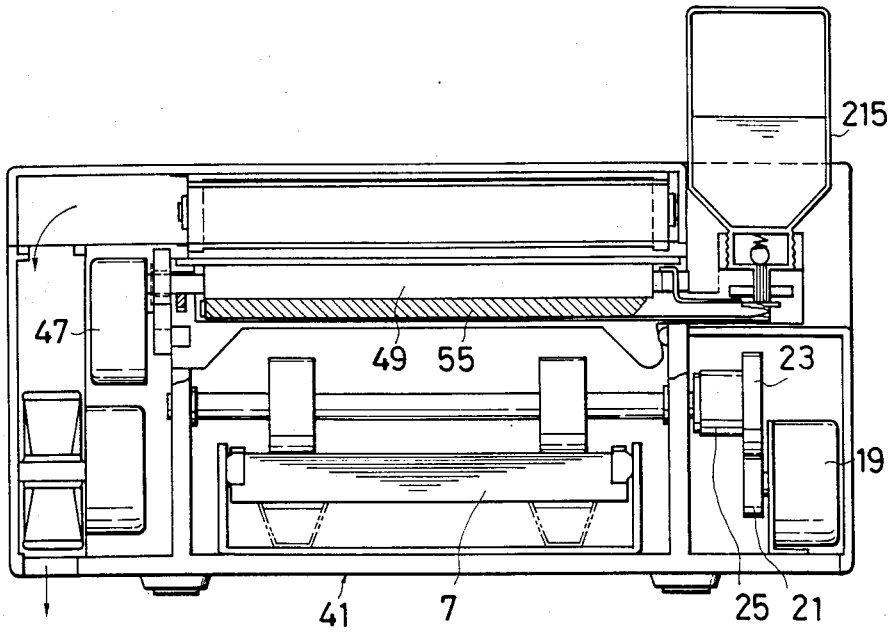

In response to a recording start command from print control unit that will be described later, the feed roller 13 causes a paper forwarding motor 19 shown in FIG. 2 to be rotated backward via gears 21 and 23 and a one-way clatch 25, to send recording papers 7 one sheet at a time. The recording paper 7 is raised along a first feed paper guide 27, transported while being held between the feed rollers 29, the tip of the paper is detected by a first paper detection sensor 30, and is put in order at the position where a first roller 31 and a resist roller 33 come into a rotational contact. The resist roller 33 is linked to the paper forwarding motor 19 via a one-way clatch unit (not shown in FIG. 2), and is rotated when the paper forwarding motor 19 is rotated forwardly.

The recording paper 7 which is put in order by the resist roller 33 is sent by the rotation of the resist roller 33 to a thermal head 35 where a predetermined printing is carried out on the recording paper 7 as will be described later. The recording paper for which recording is completed passes by a paper ejecting roller 37 and is ejected to a tray for ejected paper 39.

Figure 8:
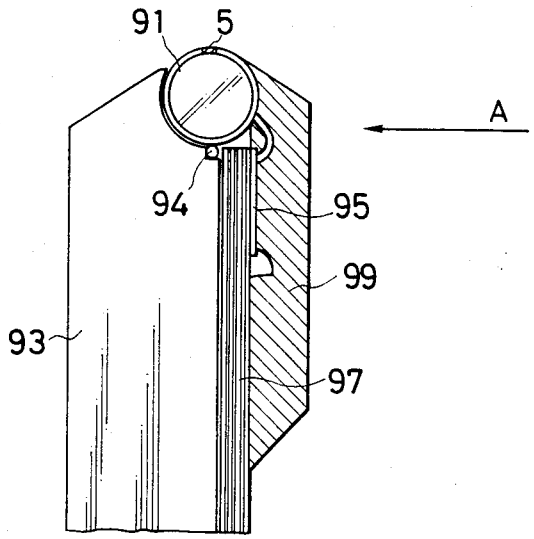
FIGS. 8 and 9 are overall block diagrams of the thermal head.
Figure 9:
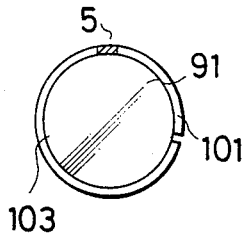

A film 1 (FIGS. 4–7) has multitude of orifices of diameter 10 to 200 um that are filled with recording ink. Recording is accomplished by spurting ink drops by means of the pressure of bubbles that are generated by rapid heating of the ink-filled multi-orifice portion 3 (FIG. 5) with an heating elements 5 (FIGS. 8–9).

Figure 3:
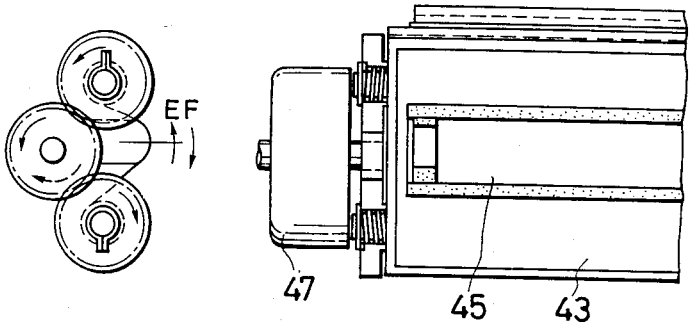
FIG. 3 is a partial block diagram of the film cartridge in the recording apparatus shown in FIG. 1.

The thermal head 35 is fixed to body 41 (FIG. 1), and a film cartridge 43 in which is housed the film 1 has a film exposure unit 45 with an aperture in a parallelepiped case, as shown in FIG. 3, and is set on the body 41 so as to enclose the thermal head 35 with the exposure unit 45. On the outer side section of the film cartridge 43 there is provided a film driving motor (pulse motor 47 by which film 1 is transported.

[Control for Positioning and Transportation of the Film]

It is necessary for the present apparatus to be controlled in such a way as to have the positions of both ends of the multi-orifice portion 3 are detected, and recording is started when the front end of the multi-orifice portion arrives above the heating element 5.

Figure 4:
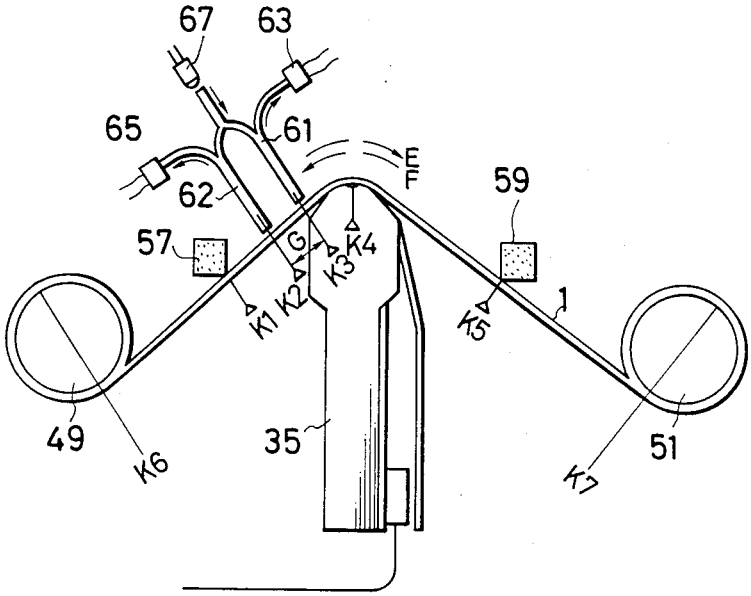
FIG. 4 is an explanatory diagram for film transportation control unit.

In FIG. 4 is shown the positional relationship between the film 1 and sensors for detecting the position of the film 1, with the thermal head 35 as the center.

The film 1 is driven in the E and F directions in the figure, centered around the thermal head 35, by the film driving motor 47, to be taken up by the paper winding shafts 51 and 49, respectively.

Figure 5:
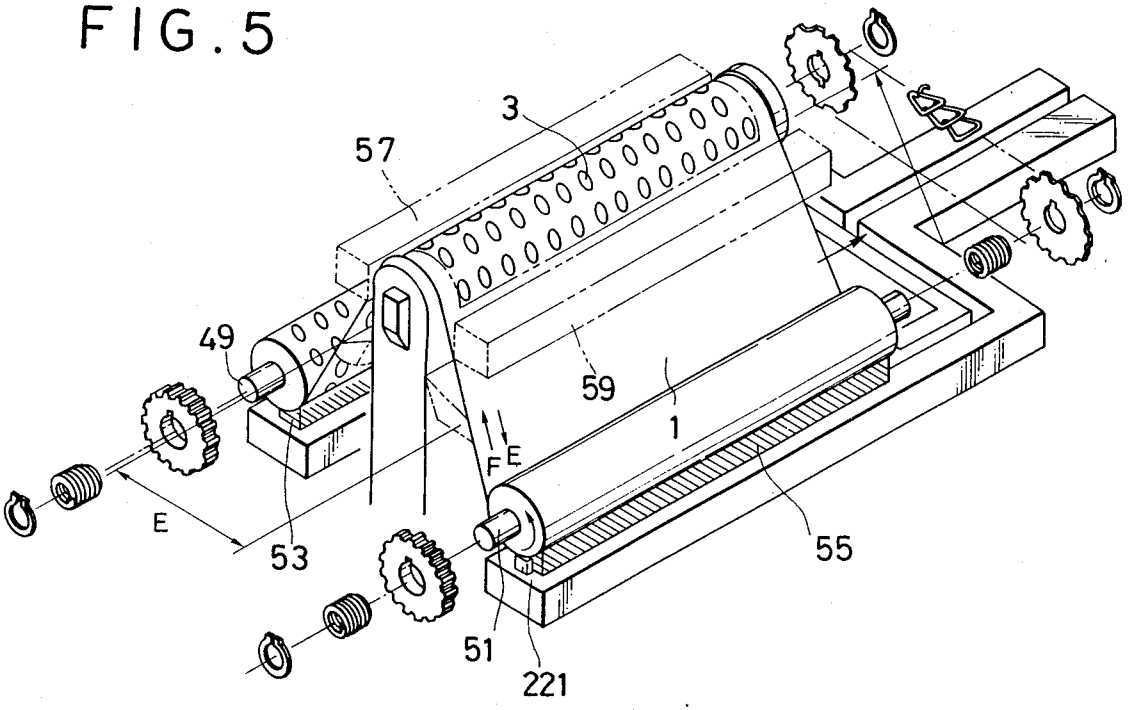
FIG. 5 is an overall block diagram for the film driving mechanism.

Further, as shown in FIG. 5, the multi-orifice portion 3 of the film which is wound on each of the paper winding shafts 49 and 51, is filled with ink by making contact with ink supply members 53 and 55 made of felt and filled with ink. Ink which is attached to portions other than the multi-orifice portion 3 is scraped off with surplus ink scrapers 57 and 59.

Moreover, on the film 1 there are provided a first and a second film position detection fibers 61 and 62 which detect the position detection holes that will be described later. Both fibers 61 and 62 are positioned at the points $K_2$ and $K_3$, respectively, arranged with a separation of a distance G. At ends of both fibers 61 and 62 there are provided a first and a second photosensors 63 and 65 for detecting reflected light from the film 1. Reflected light is obtained by reflecting light, which is supplied from a light-emitting element 67, on the surface of the film 1 via the first and the second fibers 61 and 62.

Figure 6:
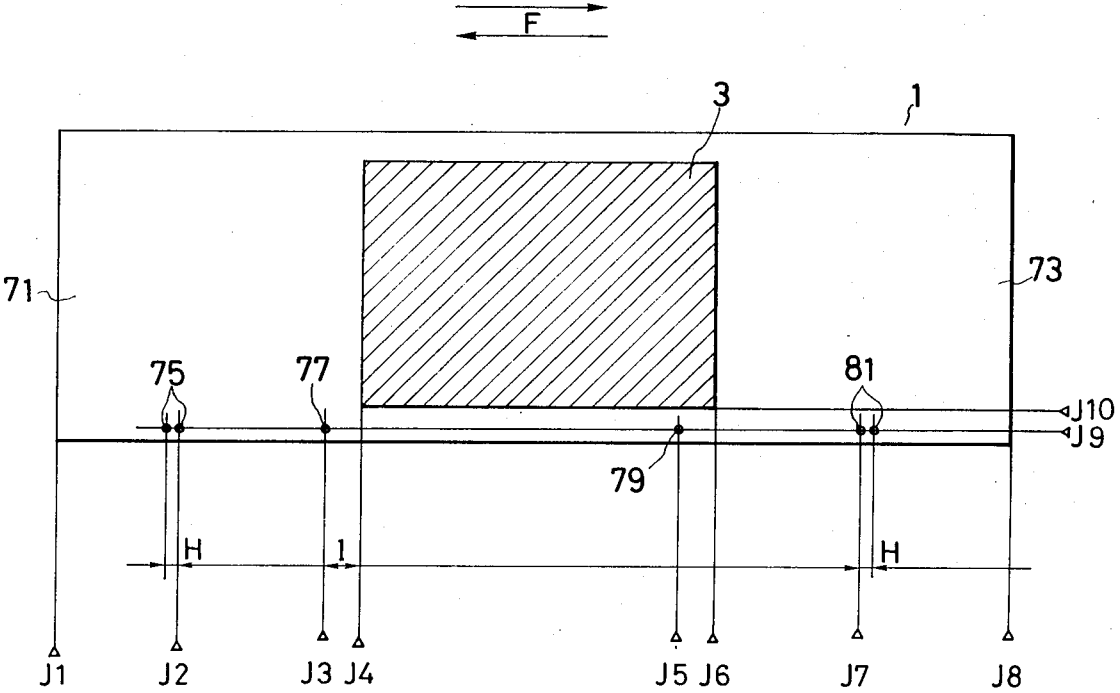
FIG. 6 and FIG. 7 are block diagrams for the film.
Figure 7:
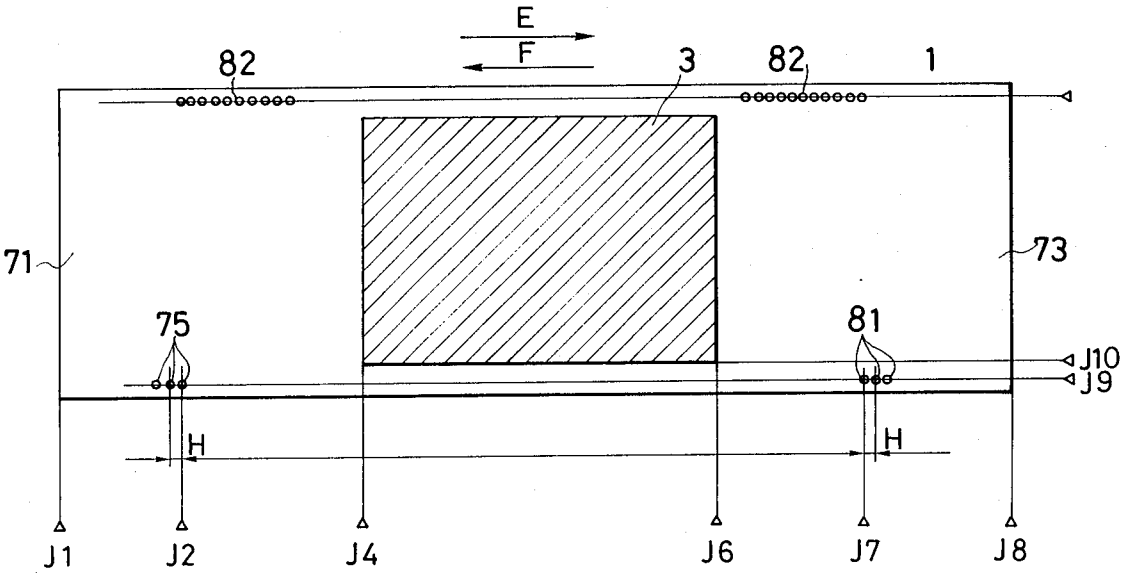

FIGS. 6 and 7 shows examples of configuration of the film 1.

In the figures, the left side where there is not formed multi-orifice portion 3 is called the left base part 71, and the right side is called the right base part 73. The position detection holes 75, 77, 79 and 81 are the holes that are provided on the end side J9 of the film 1 for detecting the film position by the film detection fibers 61 and 62 (FIG. 4).

The first position detection hole 75 on left side is for indicating the completion of transportation of the film when the film is transported in the E direction, and the first position detection hole 81 on right side is a corresponding hole when the film is transported in the F direction. The second position detection hole 77 on left side is for indicating the print start position when the film is transported in the E direction and the print completion position when it is transported in the F direction. In addition, the second position detection hole 79 on right side is for indicating the print start position when the film 1 is transported in the F direction and the print completion position in the E direction.

Further, the points J1 to J8 show the positions of the position holes and the numerous orifices. The point J1 shows the left edge portion of the film 1, J2 the first position detection hole 75 on left side, J3 the second position detection hole 77 on left side, J4 the left edge portion of the multi-orifice portion 3, J5 the second position detection hole 79 on right side, J6 the right edge portion of the multi-orifice portion 3, J7 the second detection hole 81 on right side, and J8 the right edge portion of the film 1.

The position detection holes 75 and 81 have a plurality of holes that have a pitch of H. The pitch of the holes H is equal to the distance G between the film position detection fibers 61 and 62.

Accordingly, if the portions other than those of the position detection holes 75 to 81 are at the positions of the points K2 and K3, the photosensors 63 and 65 are turned on by the reflected light from the film 1. On the other hand, if the position detection holes are at the positions of the points K2 and K3, the outputs of the corresponding photosensors 63 and 65 are in the off-state, and the detection of the position detection holes is carried out.

When the first position detection holes 75 and 81 come to the points K2 and K3, the output of both of the photosensors becomes off-state. However, the outputs of the photosensors 63 and 65 will not be in off-state simultaneously since the second position detection holes 77 and 81 are single holes individually. The drive control of the film 1 is carried out by detecting the film detection holes in the above fashion.

On the other hand, in the film configuration example shown in FIG. 7, there are provided a plurality of moving detection holes 82 of a predetermined spacing on the film end portions which face the position detection holes 75 and 81. The drive control of the film 1 is carried out as will be described later by detecting the moving detection holes 82 with a film motion detection sensor 66.

[Structure of the Thermal Head]

Figure 10:
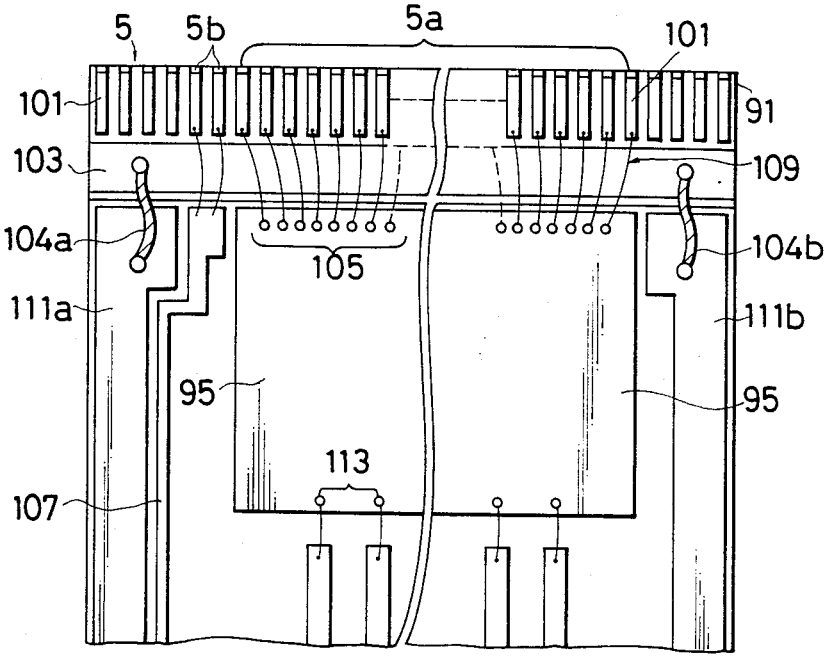
FIG. 10 is an overall block diagram of the thermal head as seen from the direction of the arrow A in FIG. 9.
Figure 11:
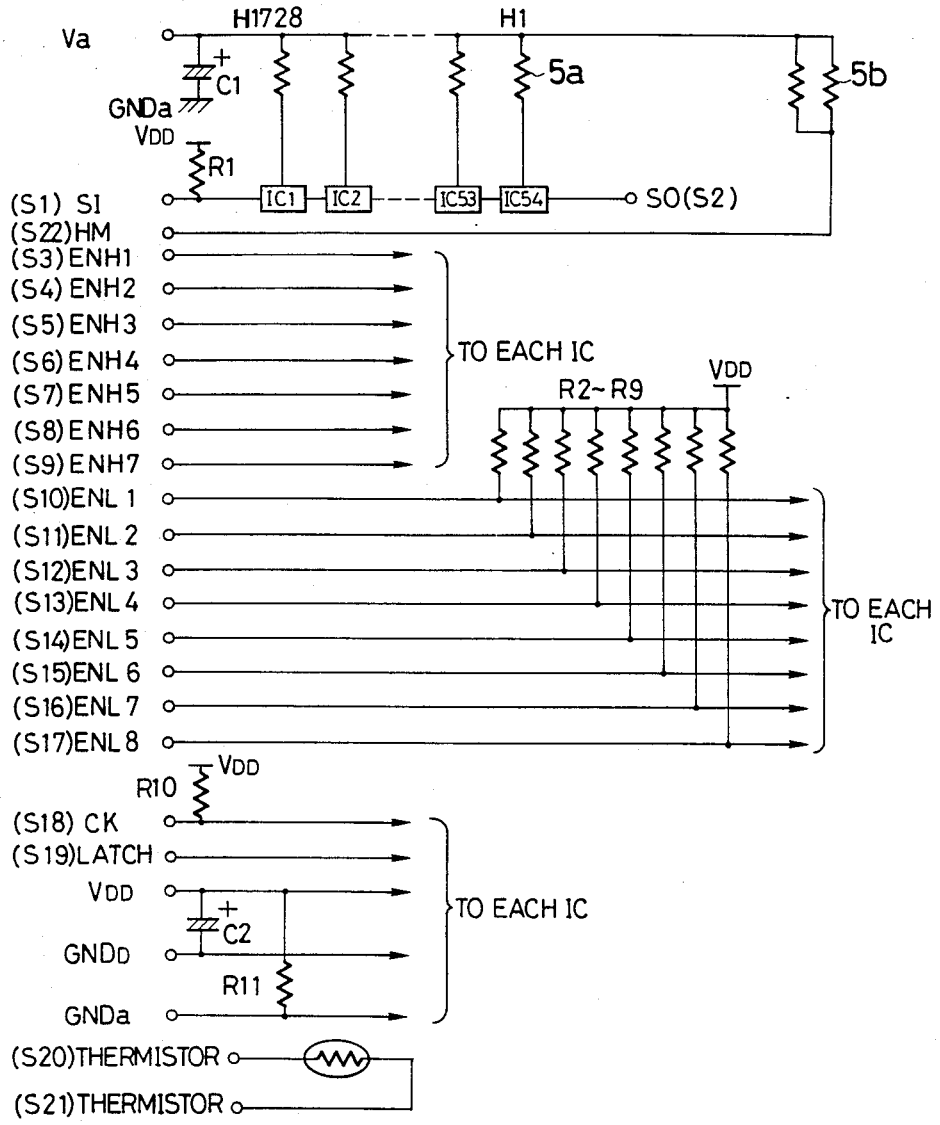
FIG. 11 is a diagram which illustrates the internal circuit of the thermal head along with the time division driving signals.

Shown in FIGS. 8 and 9 are an overall cross section and a cross section of the rod portion of the thermal head 35, shown in FIG. 10 is a side view from the direction of the arrow A in FIG. 8.

The thermal head 35 includes a metallic rod 91 on which are formed numerous heating elements 5, a supporting member 93 made of aluminum which supports the rod 91 as well as radiates heat of the rod 91, a thermistor 94 that makes contact with the lower part of the rod 91, for detecting the temperature of the thermal head 35, and a PC plate 97 that is joined to the surface of the supporting member 93 for mounting LSI 95 that drive the heating elements 5. The driving LSI's 95 are covered with a protective layer 99 made of epoxy resin.

In addition, as shown in FIG. 9, there are formed on the rod 91 an electrode pattern 101 on driving side and an electrode pattern 103 on common side, of the heating elements 5.

The heating elements 5 that are formed in large number on the rod 91 consist of, as shown in FIG. 10, the heating elements (effective heating elements) 5*a* that are used for actual printing and the heating elements (heating elements for control) 5*b* that are used for feedback control of the printing conditions.

The electrode pattern 101 on driving side of each of the effective heating elements 5*a* is connected to the corresponding output signal pad 105 of the-driving LSI 95, and the electrode pattern 101 on driving side of the heating elements for control 5*b* is connected to the heating element lead-out pattern for control 107, respectively with bonding wires 109. Further, the electrode pattern on common side 103 of the heating elements 5 (5*a* and 5*b*) is connected to the driving power supply patterns 111*a* and 111*b* that are formed on both sides of the head unit, by common lead lines 104*a* and 104*b*.

A driving LSI 95 of the present embodiment has 32 of the output signal pad 105, and is driven by time division at 32-bit unit as will be described later. In addition, the number of driving LSI's 95 used is 54, and the number of effective heating elements 5*a* is 1,728.

Consequently, the effective heating elements 5*a* are driven by time division at a unit of 32-bit so that the current that flows in the electrode pattern on common side 103 is considerably smaller than that in the thermal head which is widely in use ordinarily. Therefore, it is possible to prevent inconveniences due to voltage drop, heating of electrodes, and so forth.

[Internal Circuit of the Thermal Head]

In FIG. 11 to FIG. 14 is shown the internal circuit of the thermal head 35.

To the entire heating elements (H1 to H1728) of the effective heating elements 5*a* is supplied a driving supply voltage (+24V) Va from a power supply unit 191 that will be described later. In addition, each of the effective heating elements 5*a* is connected to each of the output terminals of the corresponding driving LSI (IC1 to IC54) as mentioned earlier.

To the serial input (SI) terminal of IC1 there is supplied a serial input data signal SI, and the serial output (SO) terminal of IC1 is connected to the SI terminal of the next IC2. In this way, IC1 to IC54 are connected in series so that a printing data that is input to the SI terminal of IC1 is shifted successively to IC54.

Namely, a serial printing data which is input synchronized with the shift clock (CK) S18 that will be described later, is held in the shift register within IC1 to IC54, a latch signal S19 is supplied on completion of input of the serial printing data, and is latched in each latch within IC1 to IC54. From latch data, one IC is selected successively from among IC1 to IC54 by the time division driving signals ENH1 to ENH7 (S3 to S9) and ENL1 to ENL8 (S10 to S17), and in this way, the effective heating elements 5*a* are driven by time division at a unit of 32-bits.

[Relationship between A Host-Side System and the Present Apparatus]

Figure 12:
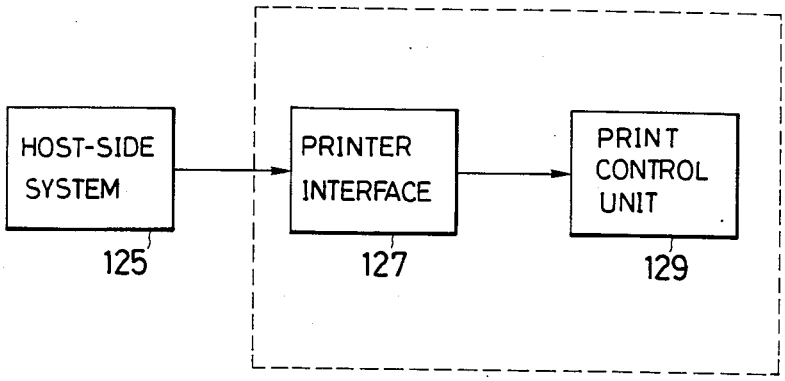
FIG. 12 is a block diagram which shows the relation between the host side system and the recording apparatus.

In FIG. 12 is shown the relationship between a host-side system and the present apparatus.

The host-side system 125 may be, for example, an office computer which sends out a printing data and a command data to a printer interface 127. Upon receipt of a command data, the printer interface 127 sets up the printing mode for the print control unit 129.

The printing data includes character data and bit image data. The character data is sent out, after it is developed into a bit image for the character by a character generator in the printer interface 127, to the print control unit 129. The bit image data, on the other hand, is sent out to the print control unit 129 as it is.

[Configuration and Operation of the Printer Interface]

Figure 13:
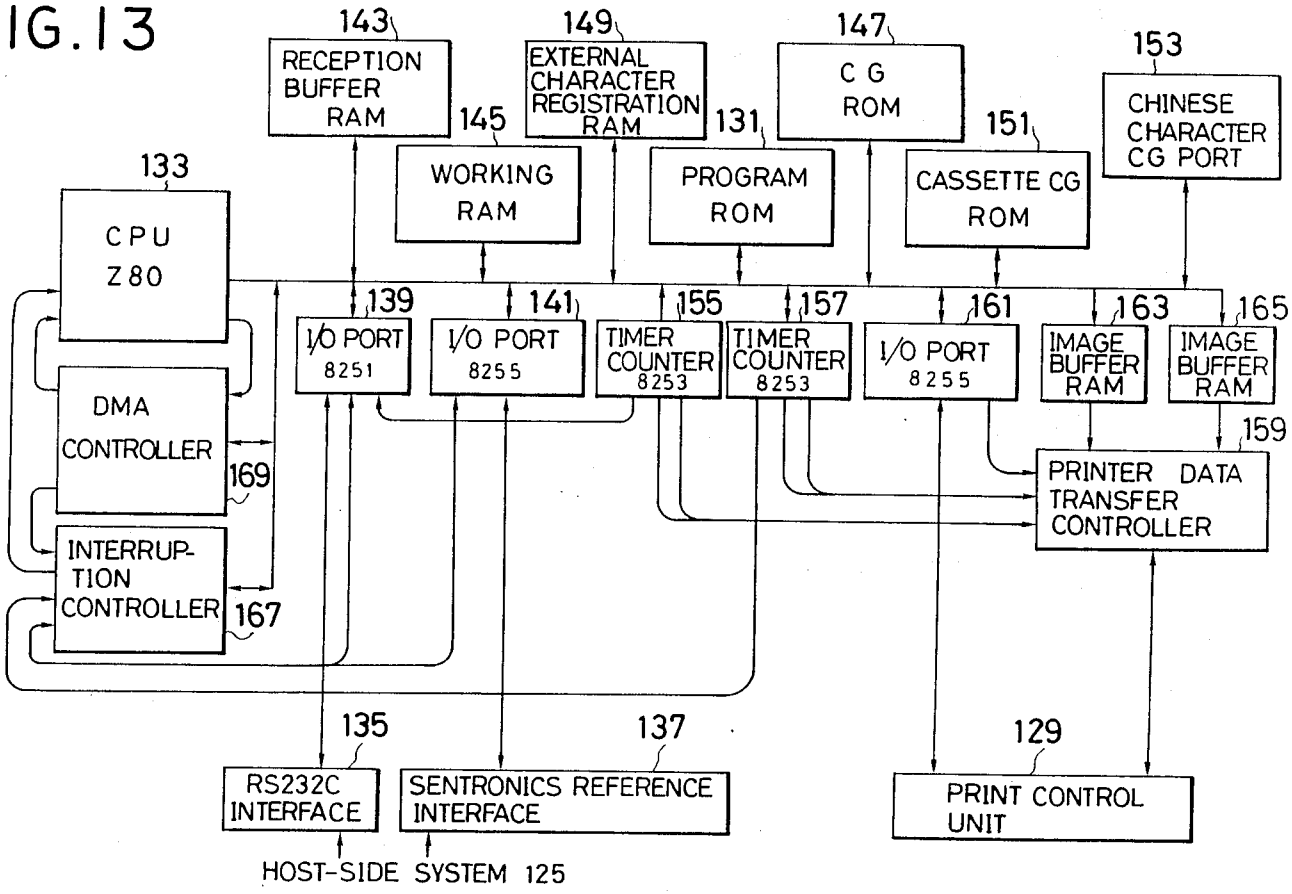
FIG. 13 is a block diagram which shows he configuration of the printer interface.

In FIG. 13 is shown the configuration of the printer interface 127.

The printer interface 127 is controlled by a microprocessor (CPU) 133 according to a control program that is housed in a program ROM 131.

The data (printing data and command data) from the host-side system 125 is input via the interfaces 135 and 137. The interface 135 is a general purpose serial interface and use is made, for instance, of RS-232C. In addition, the interface 137 is a general purpose parallel interface according to Sentronics. Further, serial communication control is carried out by an input-output port 139, and parallel communication control is carried out by an input-output port 141.

An input data is stored temporarily in a reception buffer RAM 143. When the input data is a character, the data in the reception buffer RAM 143 is developed into a bit image by using a working RAM 145.

In a character generating ROM (CGROM) 147 there are stored character patterns that are equipped typically. In using a character which is not stored in CGROM 147, a character pattern loaded from the host-side system 125 is stored in an outside character registering RAM149. A cassette CGROM151 is a freely attachable and detachable ROM which stores character patterns other than those in the CGROM147. In Chinese character CG board 153 there are stored Chinese character patterns of mainly first and second JIS levels.

Timer-counters 155 and 157 are programmable counters which carry out various kinds of time control and counter control for a reference clock to the input-output port 139 for serial communication and for a printer data transfer controller 159.

Parallel I/O port 161 carries out transmission and reception of control signals between the print data transfer controller 159 and the print control unit 129.

In the two image buffers RAM163 and 165, bit image data is stored temporarily, and they are used alternately when transmitting data to the print control unit 129.

The print data transfer controller 159 carries out control in transmitting data to the print control unit 129.

[Configuration of the Print Control Unit]

Figure 14:
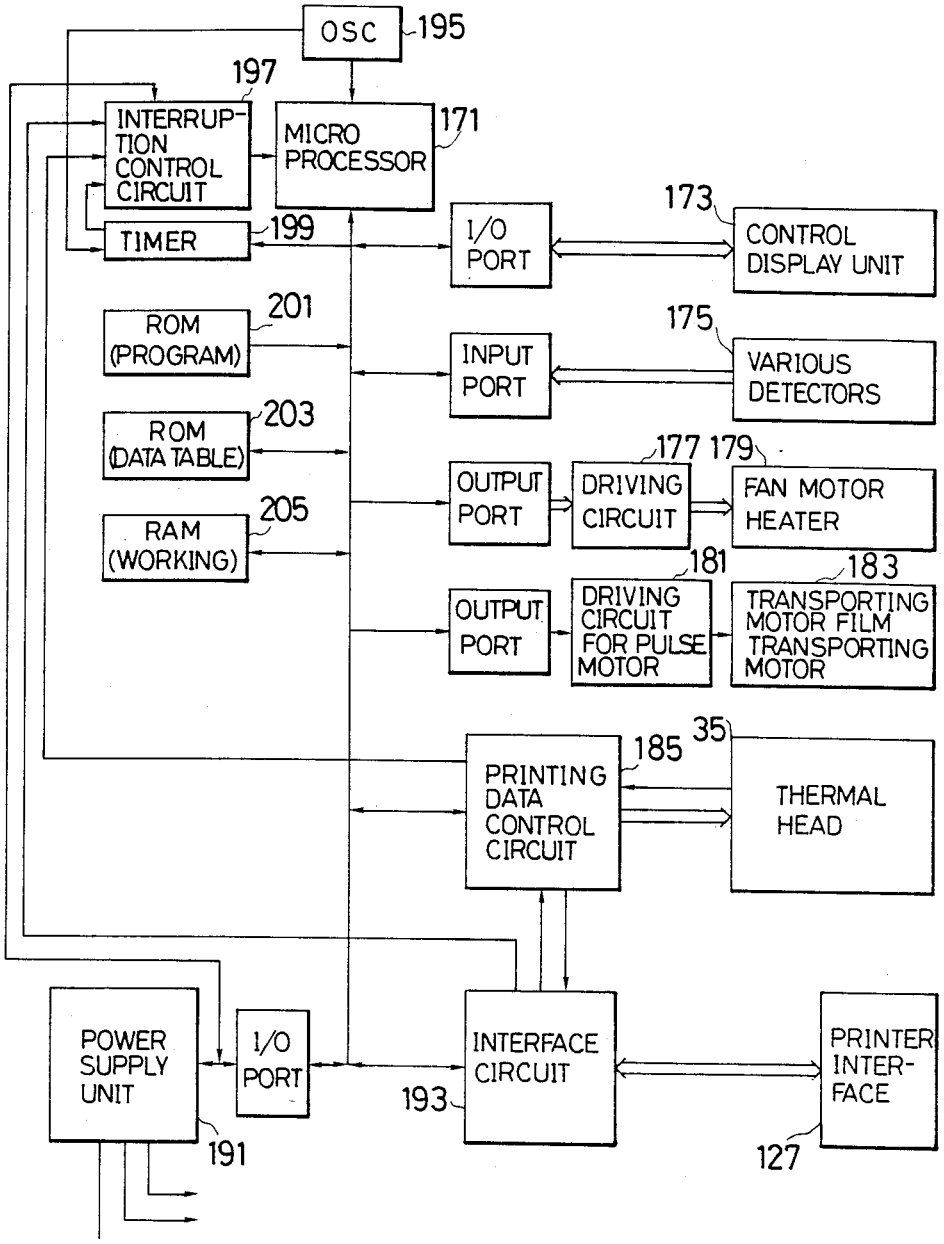
FIG. 14 is a block diagram which shows the configuration of the print control unit.

FIG. 14 shows the configuration of the print control unit 129.

The print control unit 129 is constructed with the microprocessor 171 as the control center. Its input-output ports are connected to a control display unit 173 that is provided with control keys and lamps for displaying the operational conditions, various detectors 175, a fan motor and a heater 179 via a driving circuit 177, a pulse motor for transporting recording paper and a film transporting pulse motor 183, via a pulse motor driving circuit 181, a printing data control circuit 185, and the printer interface 127, via a power supply unit 191 and an interface circuit 193.

In addition, the print control unit 129 includes an oscillator (OSC) 195 which generates reference clocks that are supplied to various timer circuits, microprocessor 171, and others within the print control unit 129, an interruption control circuit 197 which controls the demands for interruption that come from the printing data control circuit 185, the interface circuit 193, a timer 199, and others, a program timer 199 with a plurality of channels that control the mechanical timings (for paper feeding, paper check, and various kinds of motors) of the print control unit 129, a ROM201 with built-in control program, a ROM 203 for data table with built-in timing data of various kinds, and a working RAM205.

[Configuration and Operation of the Printing Data Control Circuit]

Figure 15:
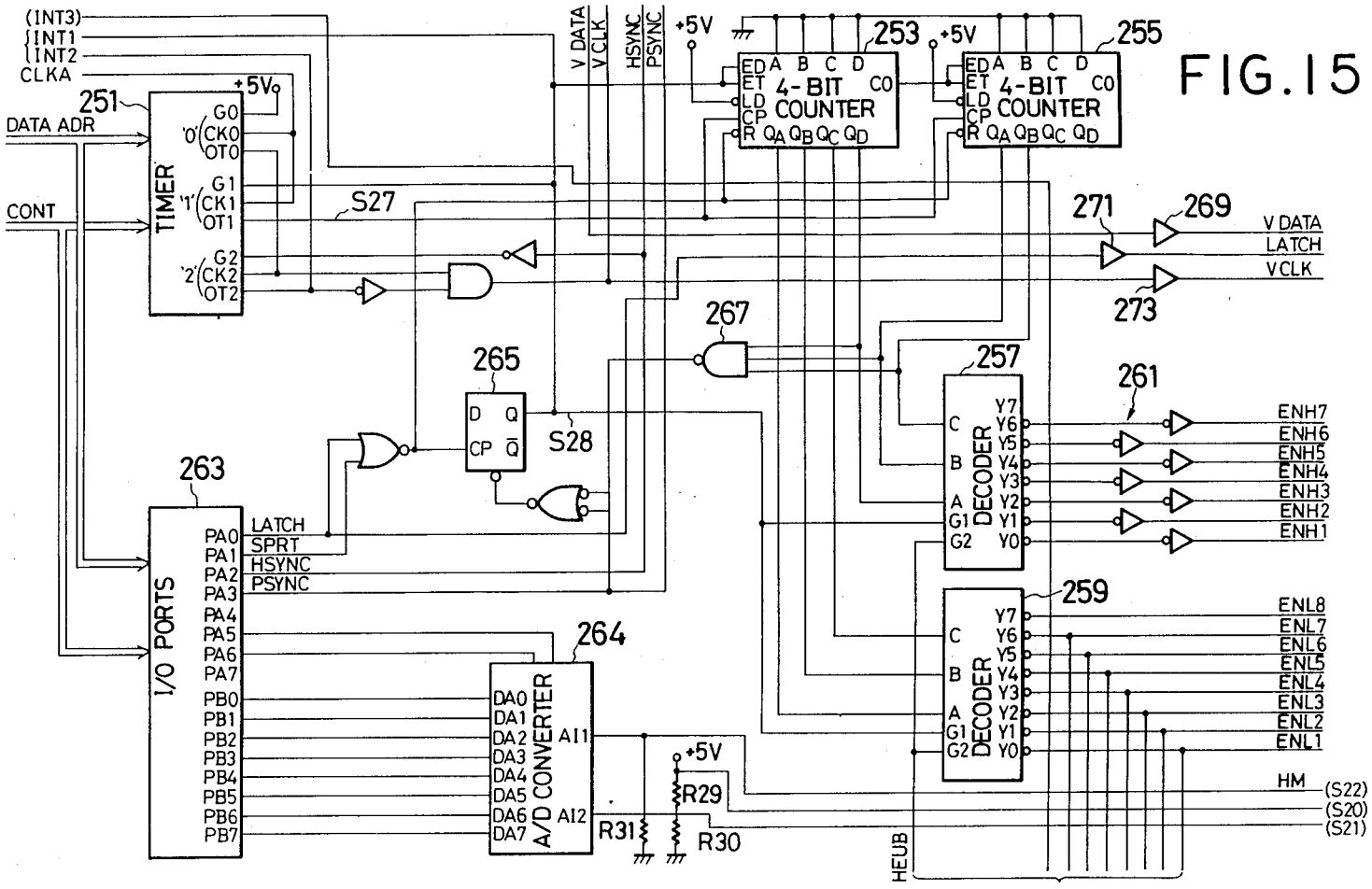
FIG. 15 is a block diagram which shows the configuration of the printing data control circuit.

In FIG. 15, the timer 251 is a timer (825 made by Intel Co.) which has three built-in timer circuits. Timer "0" of the timer is used for generating video clocks (corresponding to the transfer of one picture element) VCLK during printing operation. Timer "1" is used to obtain fundamental driving pulses ENL1 to ENL8 during time division driving of the thermal head. Timer "2" is used for controlling the send out number of one line of the video clocks VCLK. The 4-bit counters 253 and 255 are counters (corresponding to LS117 of Texas Instruments) which count the driving fundamental pulses S27, and generate time division driving control signals ENL1 to ENL8 and ENH1 to ENH7.

Decoders 257 and 259 decode outputs of the counters 253 and 255, and send out the time division driving control signals ENL1 to ENL8 and ENH1 to ENH7 to the thermal head 35 via inverters 261 that are provided separately. In addition, the outputs are sent out also to the thermal head protection check circuit 262 where check on the pulse width is carried out. When an abnormality is detected as a result of the pulse width check, head enable signal HENB becomes "L" level and the outputs of the decoders 257 and 259 both become "H" level, so that the driving of the thermal head 35 is brought to a stop instantly.

The port output PA0 of the input-output port 263 is a signal LATCH output for latching the data that are sent out serially to the output latch in the thermal head, port output PA1 is a trigger signal SPRT output for driving again the time division driving signal which is done in printing one line for two times in order to enhance the printing density, and port output PA2 is the horizontally synchronized signal (line synchronization signal) HSYNC in printing one line, and port output PA3 is the page synchronization signal PSYNC for one sheet of paper.

Flip-flop 265 is for controlling the output enable in the case of printing one line, which is operated so as to output an enable signal for once the case of single printing and for twice n the case of double printings. The flip-flop 265 is set by the LATCH signal and the trigger signal SPRT, and is reset when the counters 251 and 253 are counted up and the inputs of the gate 267 become all "1".

To the thermal head 35, time division driving control signals ENL1 to ENL8 and ENH1 to ENH8, video clock signal VCLK, output latch signal LATCH, and video data signal VDATA are sent via output buffers 269, 271, and 273.

In addition, to the interface circuit 193, there are sent the page synchronization signal PSYNC, line synchronization signal HSYNC, and video clock signal VCLK, and from the interface circuit 193, there is sent out a video data VDATA synchronized with the video clock signal VCLK by the printer interface 127.

Figure 16:
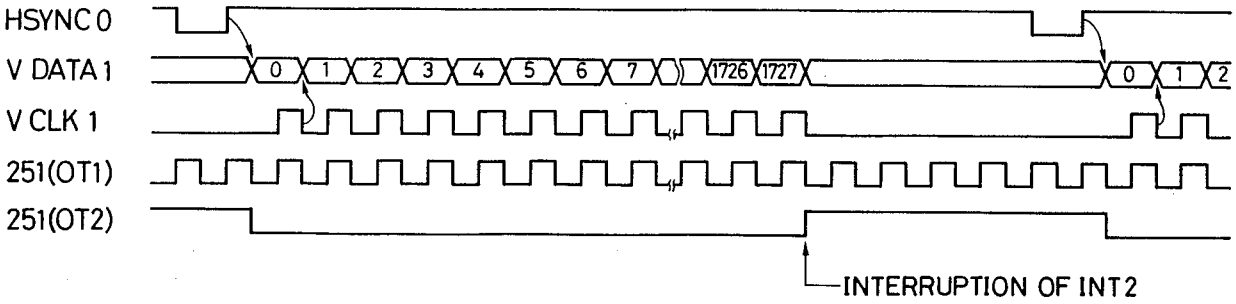
FIG. 16 and FIG. 17 are time charts which show the relationship between various kinds of signals of the printing data control circuit.

In FIG. 16 is shown the relationship among the line synchronization signal HSYNC, video data signal VDATA, and the output signals of OT1 and OT2 of the timer 212, of FIG. 15.

Figure 17:
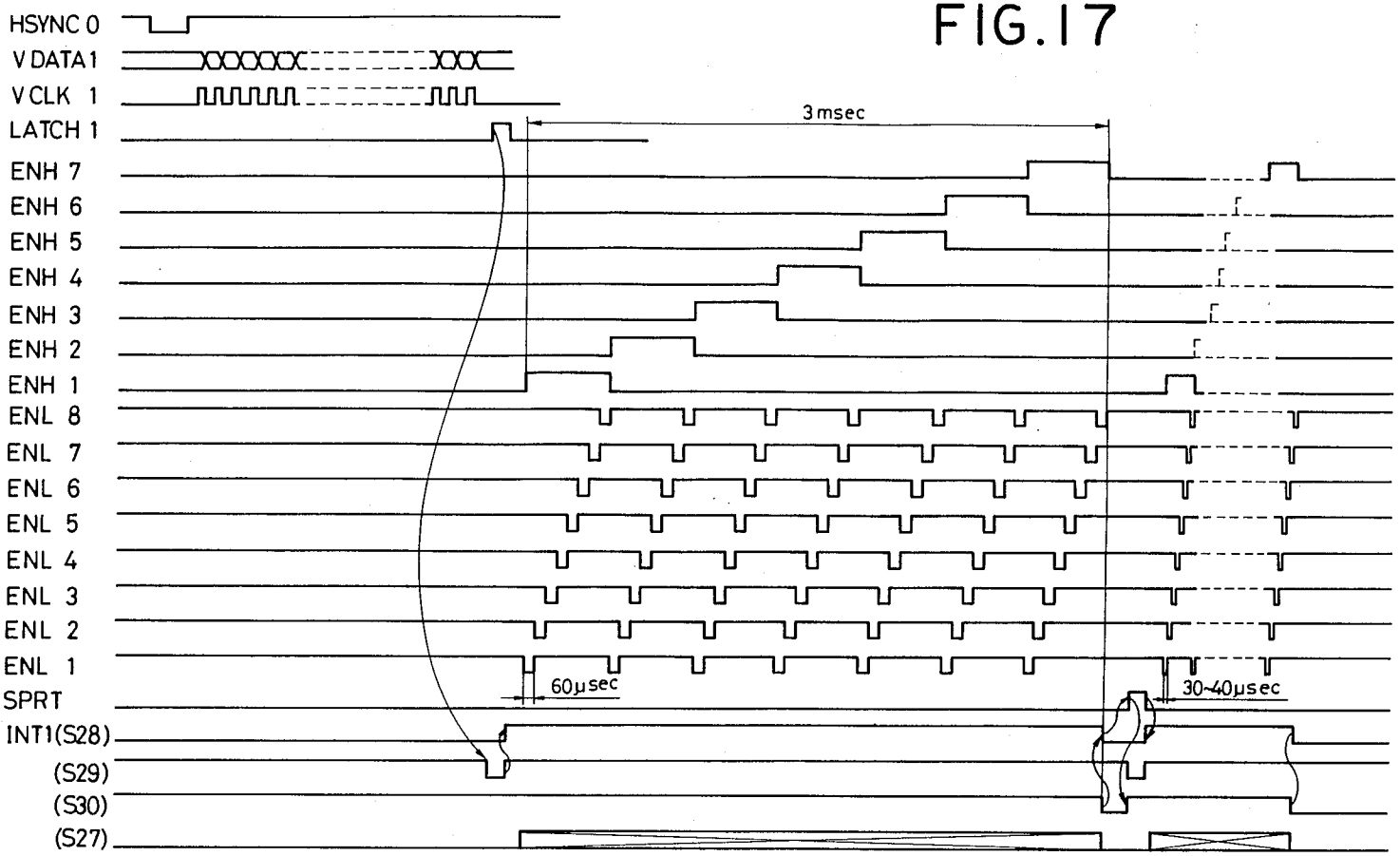

In FIG. 17 is a timing chart that shows the relationship among the line synchronization signal HSYNC, video data signal VDATA, video clock signal VCLK, latch signal LATCH, time division driving control signals ENL1 to ENL8 and ENH1 to ENH7, double printing control signal (trigger signal) SPRT, output INT1 (S28) of output enable control flip-flop 265, and so on of FIG. 15. It shows the operational timings for the case of carrying out printing twice for one line (double printing).

When single printing is designated from the printer interface 127, trigger signal SPRT is not output so that the head 35 is driven for only once. Further, to the interruption control circuit 197 is connected the output S28 of the FF265 for output control enable and the output of the timer 251 (OT2) for controlling the sending number of one line.

The flip-flop 265 is used for controlling the double printing. Namely, when the drive for the first time is completed, the flip-flop 265 is reset. By the change in the output, the microprocessor 171 is interrupted, and the microprocessor 171 outputs a trigger signal SPRT which is the signal for starting a second drive, on the output port 213 (PA1).

The timer 251 is used for controlling the time division driving of the head 35 after the latching operation. Namely, the microprocessor 171 is interrupted by the change in the output of the timer 251 (OT2), and the microprocessor outputs a latch pulse LATCH to the output port 263. Thereafter, driving operation of the head by time division will take place.

[Configuration and Operation of the Interface Circuit 193]

Figure 18:
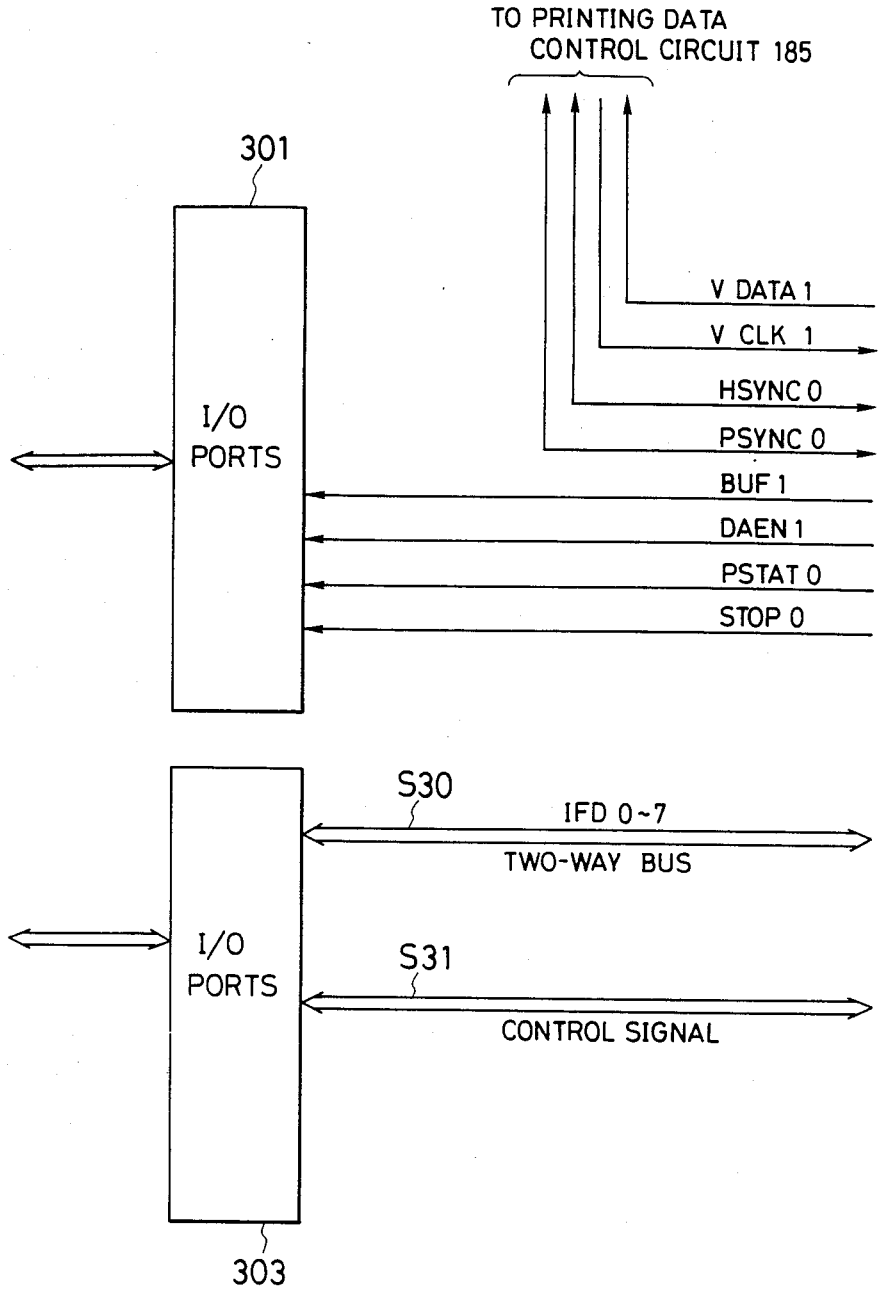
FIG. 18 is a block diagram which shows the configuration of the interface circuit.

FIG. 18 shows details of the interface circuit 193 in FIG. 14. The interface circuit 193 is a circuit for exchanging the printing data, control command/status data, and so forth between the printer interface 127.

In FIG. 18, 301 is an input-output port for transferring signals used for transfer control of the printing data, and 303 is a port for transferring mainly the command/status data. In addition, four signals, namely, the video data signal VDATA1, video clock signal VCLK1, line synchronization signal HSYNC0, and page synchronization signal PSYNC0, are connected to the printing data control circuit 185. BUF1 signal is a signal which is used in transferring the printing data from the printer interface unit 127. When this signal is "1", it signifies that preparation is complete for the transfer of the printing data block. DAEN1 indicates that the data which is now being sent out is an effective data (data that is to be printed on the recording paper). PSTAT0 signal is a start signal for one page of printing, and STOP0 signal is used for halting temporarily the printing operation from the printer interface 127. IFD0 to IFD7 (S30) are two-way balances for command and status data and S31 is a control signal line for data strobe, busy signal, and others.

FIG. 19 shows various kinds of command that are sent out from the printer interface 127.

Status demand commands "SR1" and "SR2" are for sending out status data on the bus when the status of the print control unit is read, which are sent out before and after printing of one page to monitor the state of the print control unit 129.

Select lamp lighting command "SELON" is for lighting the select lamp in the display control unit 173, and select lamp putting-out command "SELOFF" is for putting the lamp out.

Data designation command "PSEL" is a command for designating the data that is sent out from the printer interface 127. By this command, the state of image and character is switched every time when a command is sent out.

Image density selection command "IDSEL" is a command for selecting the image density of printing, and every time when this command is sent out, density designation is switched between the states of high and low. When the density is "high", the operation of double printing takes place and when it is "low", the single printing takes place.

As described, in this apparatus, it is possible to automatically adjust the print density in accordance with an instruction and to accomplish many valued recording. Further, this apparatus is capable of varying the print density of the same dot unless the other method is used.

FIG. 20 shows the status of the print control unit 129. In the figure, the 8-bit status in the upper row is sent out to the bus by means of the status demand command "SR1" and the items in the lower row are sent out by "SR2".

Of the status that can be called by means of the status demand command "SR1", "SELECT SWON" becomes "1" when the select switch in the control display unit 173 is turned on. This status becomes "0" upon receipt of the command "SELON" or "SELOFF". "READY" becomes "1" when the printer interface 127 is ready to print. The density changes in the order of density "1" (high) and density "0" (low) by receiving the "IDSEL" command. "IMAGE" changes in the order of image "1" and character "0" on receipt of the "PSEL" command. "CASSETTE SIZE" displays the size of the currently mounted cassette in combinations of three bits.

Next, the status by means of the command "SR2" is one that is used when the "READY" in the above is in the state of "0", and "NO PAPER" becomes "1" when there is no paper in the cassette.

"PAPER JAM" becomes "1" when the paper is jammed while it is on the printer transporting route. "COVER OPEN" becomes "1" by a microswitch (not shown) which is activated by the opening and closing operation of the transportation mechanism in the upper recording unit shown in FIG. 2. "NO INK" becomes "1" when there remains no ink in the ink bottle.

[Data Transfer between Printer Interface 127 and Print Control Unit 129 and Drive Control of Each Pulse Motor in Print Control Unit, during Character Printing]

The operation will be described by making reference to the timing chart shown in FIG. 21.

Upon receipt of a printing data from the host-side system, the printer interface 127 examines the state of the print control unit 129 by sending out a status command (SR1 or SR2) corresponding to the printing conditions. After judging that the print control unit 129 is ready to print as a result, it sets printing conditions by sending out a command which designates the printing conditions, to the print control unit. Then, it shifts the print start signal PSTAT1 to "H" level.

Upon receipt of the print start signal PSTAT1, the print control unit 129 causes to rotate the feed roller 13 by rotating the paper forwarding motor 19 in the reverse direction to take out a sheet of printing paper 7 from the cassette 9. The paper taken out is further transported toward the resist roller 33 by the feed roller 29. The tip of the paper transported is detected by the first paper detection sensor 30. The detected signal is supplied to the microprocessor 171.

After discriminating the detected singnal, the microprocessor 171 sets the timer 199. By this, the paper is transported for a fixed length of time. After the above paper feeding operation, the tip of the paper is put in good order by the resist roller 33.

In parallel with the paper feeding operation in the above, the film 1 is transported to the printable position by the film drive motor 47. Namely, the film setting operation is started by the left film position hole 75 or right film position hole 81 in FIG. 7. FIG. 42 illustrates the situation by assuming that the whole thing started from the state in which the point J2 in FIG. 7 was detected by the first film sensor 63.

When the microprocessor 171 receives a print start signal PSTAT 1, it sends out a pulse motor drive pulse in order to rotate the film drive motor 47 in the forward direction. In this case, by setting the timer 199 that controls the speed of rotation of the pulse motor to a timer value which corresponds to the fast mode, the film drive motor 47 is rotated in the positive direction with the speed of rotation of "1" (high speed).

Here, the film send-out counter provided in the working RAM 205 in FIG. 14 counts up "1" every time when one pulse motor driving pulse is sent out. Consequently, the pulse motor driving pulse is sent out until the counted value coincides with the pulse number NA up to the point J4, which is stored in the ROM 203 (data table). When the counted value reaches NA, the film drive motor 47 is brought to a stop when the multi-orifice portion 3 of the film 1 finds itself situated above the thermal head 35.

When the paper feeding operation for the recording paper 7 in the above is completed, a page synchronization signal PSYNC0 is sent out to the printer interface. Upon receipt of the signal, the printer interface 127 shifts the print stop signal STOP0 to "H" level and permits the sending of a horizontally synchronized signal HSYNC0.

The print control unit 129 causes the paper forwarding motor (PFM) 19 to rotate in the forward direction in order to forward the paper 7 which is held at the resist roller 33 to the thermal head 35. Starting with the time when the tip of the paper 7 reaches the position above the thermal head 35, the horizontally synchronized signals HSYNC0 are sent to the printer interface 127. The horizontally synchronized signal HSYNC0 is sent out for a duration that corresponds to the length of the recording paper 7. In addition, corresponding to the sending of the horizontally synchronized signal HSYNC0, the film drive motor (IRM) 47 is driven, and the film 1 is transported at a speed which is one half of the paper forwarding speed. In other words, drive pulses are sent to the microprocessor 171 at the rate of one for every two horizontally synchronized signals HSYNC0.

When the horizontally synchronized signal HSYNC0 is sent out corresponding to the length of the paper 7, the film 1 is further transported in the F direction in the high speed mode. By the detection of the film position hole 81 at the point J7 in FIG. 8 by the first film sensor 63, the drive of the film drive motor 47 is brought to a stop. In this state, the multi-orifice portion 3 of the film is housed in the film cartridge 43 so that the film cartridge 43 is in a state which is tightly shut out from the outside. Further, the stoppage of driving of the paper forwarding motor 19 takes place at the point in time when the rear end of the recorded paper 7 passes by the position above the second paper detection sensor 32 that is provided in the paper ejection unit. When the paper ejection is completed, the page synchronization signal PSYNC0 is changed to "H" level, and the system enters the standby state which is ready to accept the start of the next printing.

When a next printing start signal PSTAT1 is received in this state, since the film 1 is stopped in the state in which the point J7 in FIG. 7 is detected, the print control unit 129 transports the film in the E direction, and gives pulses that correspond to the value NB to the film drive motor 47 until the film arrives at the point J6 which is the point for starting printing.

Moreover, while the film 1 is in transportation, signals from the film motion detection holes shown in FIG. 15 are checked. These motion detection holes 82 carry out detection of undetected hole portion of the motion detection hole unit, using a film motion detection sensor 66 which is operated by the same principle as the first film position detection sensor 63. As shown in FIG. 15, signals from the film motion detection sensor 66 are read through the input port by the microprocessor. The spacing of the motion detection holes in this embodiment is given a pitch which corresponds to the length of four pulses that are applied to the film drive motor 47. Accordingly, when the signal changes due to the film motion holes are detected during film transportation, the microprocessor 171 sets predetermined bits in the internal register.

The bits in the above are reset after outputting driving pulses to the film drive motor 47. Then, prior to outputting a fourth driving pulse, a judgment is formed whether or not the above-mentioned bits are actually set. If they are found set, the bits are reset after outputting of the drive pulse, and film transportation is continued. If they are not set, the drive of the heating elements is stopped at that point in time, and the printing operation is brought to an end.

Figure 21:
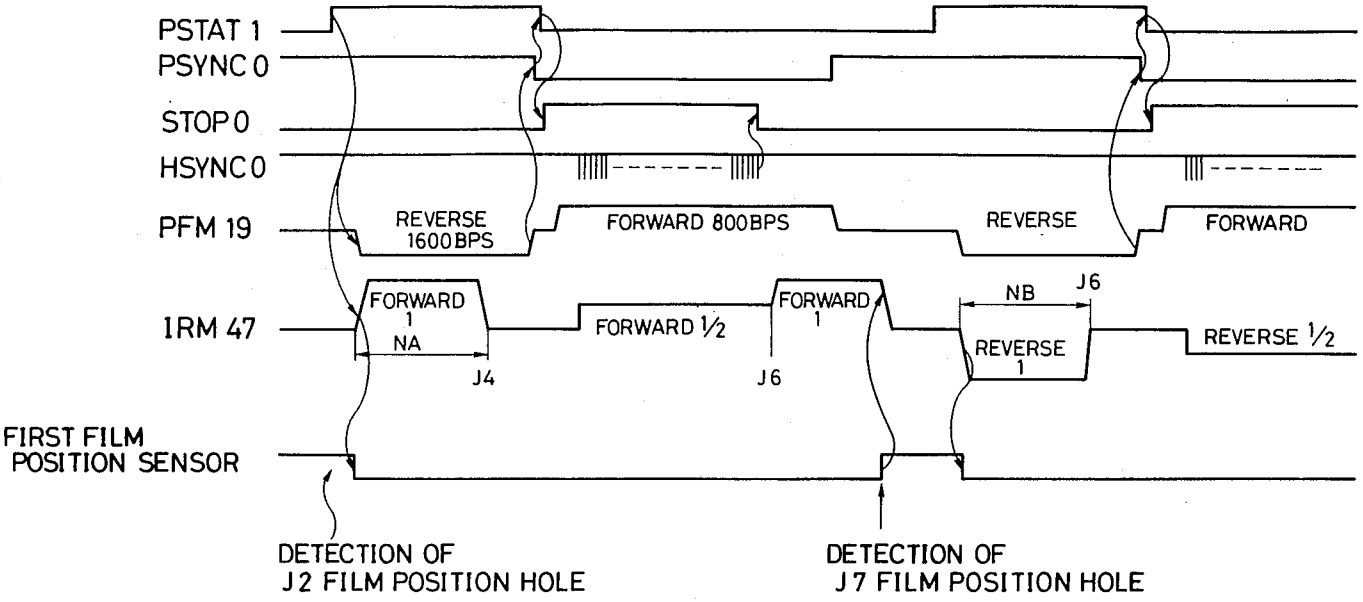
FIG. 21 to FIG. 23 are time charts at the time of letter data printing.
Figure 22:
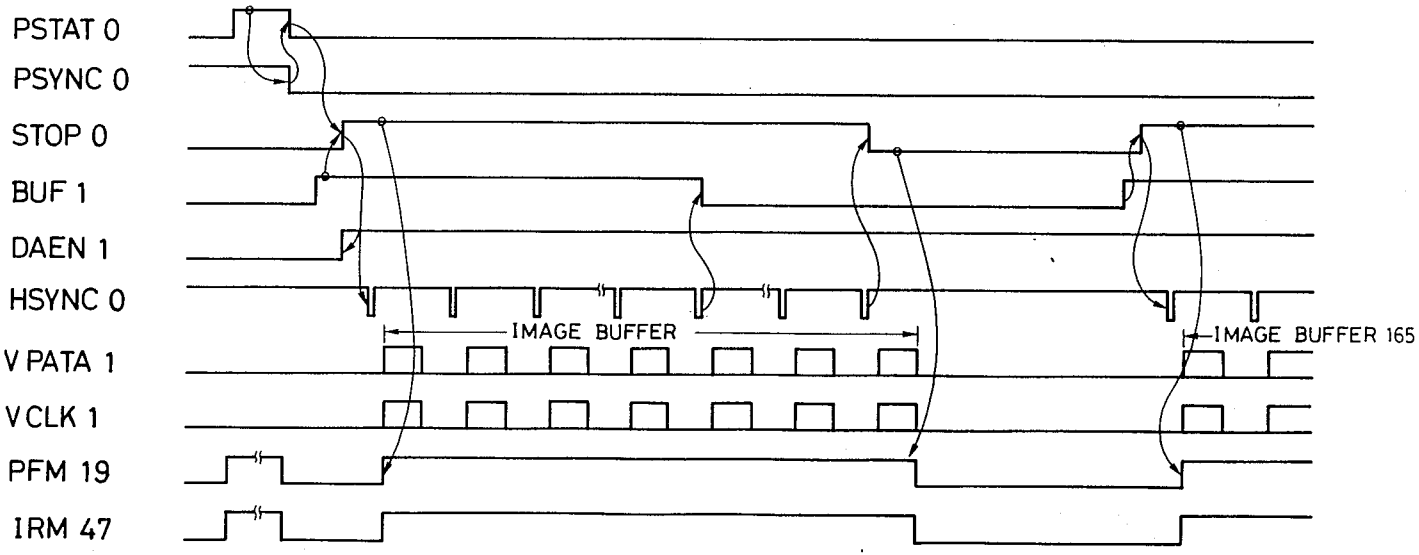
Figure 23:
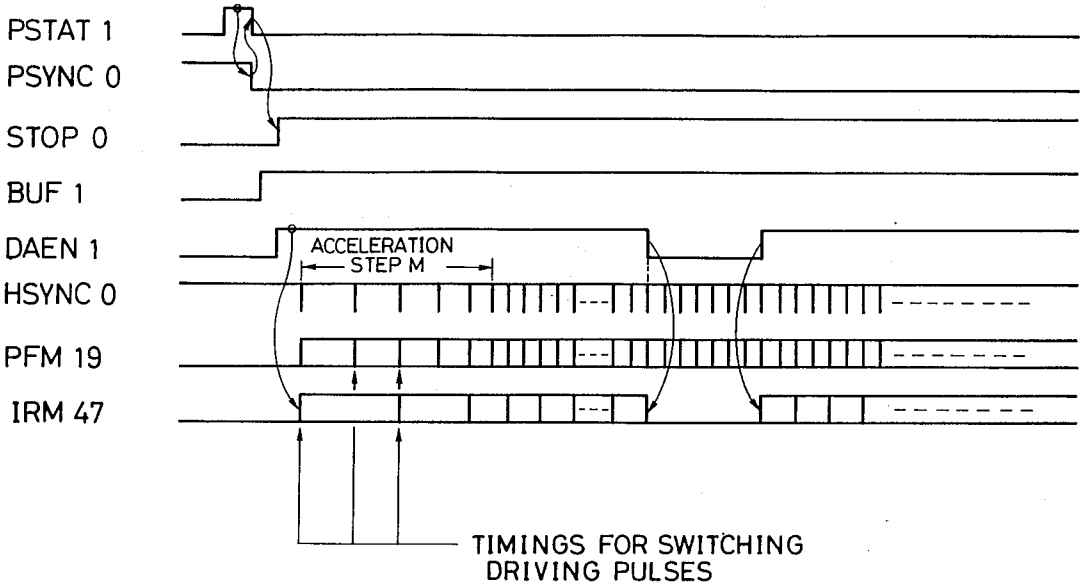

FIG. 22 and FIG. 23 are diagrams that show detailed timings during printing operation shown in FIG. 21.

In FIG. 22, if the page synchronization signal PSYNC0 on the printer interface 127 side becomes "L" level, the print start signal PSTAT1 becomes "L" level.

When the bit development to the image buffer RAM's 163 and 165 is completed, the BUF1 signal which shows the presence of a data that is sent out from the image buffers 163 and 165 becomes "H" level, and the stop signal STOP0 which brings the printing operation to a temporary stop becomes "H" level(that is, releases the stoppage). In addition, the DAEN1 signal which shows that the data sent out is the data to be actually printed, becomes "H" level. With this, the print control unit 129 sends out the horizontally synchronized signal HSYNC0, and sends out one line portion (1728 in number) of the synchronization clock VCLK1 of the printing data.

Figure 27:
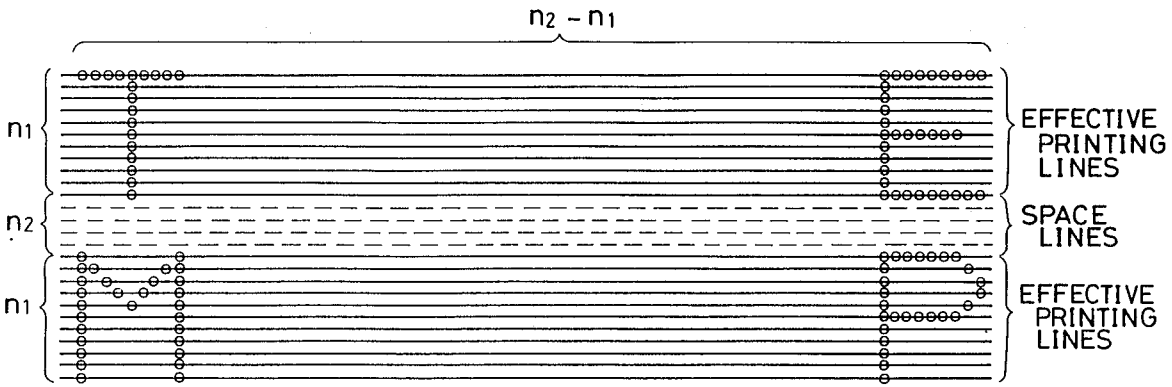
FIG. 27 is a diagram which shows the example of printed letters.

By the horizontally synchronized signal HSYNC0 and synchronization clock signal VCLKl, the printer interface 127 sends out the printing data in the image buffers 163 and 165 to the print control unit 129. In FIG. 27 that shows the aspect of character printing, a line unit is divided into effective lines n1 and space feeds n2. Accordingly, the DAEN1 signal is controlled so as to have it on "H" level during the period in which n1 line synchronization signals HSYNC0 are sent out. In addition, during the time when the DAEN1 is on "L" level, that is, in the segments for space feeds, there takes place the simple operation of paper feeding, without carrying out printing, so that the driving of the film drive motor 47 is stopped. When the DAEN1 signal becomes "H" level, the driving of the film drive motor 47 is started.

By arranging to carry out the film transportation operation as above, it is possible to reduce the length of the multi-orifice portion 3 of the film 1.

FIG. 23 is an explanatory diagram about the timing for impressing driving pulses to the paper forwarding motor 19 and to the film drive motor 47 during the operation shown in FIG. 22.

The driving pulses to the paper forwarding motor 19 is given in an accelerated manner as shown in the figure. This is done so because of the inertia that exists in the driving portion, to use the motor more efficiently, by shifting the speed of the motor at the start of the driving from a low speed to a high speed in succession.

Therefore, after completion of the acceleration segment shown in the figure, the paper forwarding motor 19 begins to rotate at a constant speed. The driving pulses for the film drive motor 47 are given synchronized with the driving pulses that are given to the paper forwarding motor 19. However, the film transporting speed for set at one half of the transporting speed of the paper so that the driving pulses for the film drive motor 47 are given at the rate of one for every two driving pulses of the paper forwarding motor 19. In addition, the horizontally synchronized signal HSYNC0 is supplied to the printer interface 127 synchronized with the driving pulse for the paper forwarding motor 19.

The control of the driving pulses to the drive motors 19 and 47 is carried out to realize an accelerated operation and a decelerated operation of the motors 19 and 47, by changing the data set to the timer 199 for each interruption demand. Further, in this example of operation, the data transfer to the image buffers 163 and 165 on the printer interface 127 side is carried out faster then the speed of printing, so that both of the stop signal STOP0 and the BUF1 signal are in "H" level state and the paper forwarding motor 19 is operated continuously without being halted.

Figure 26:
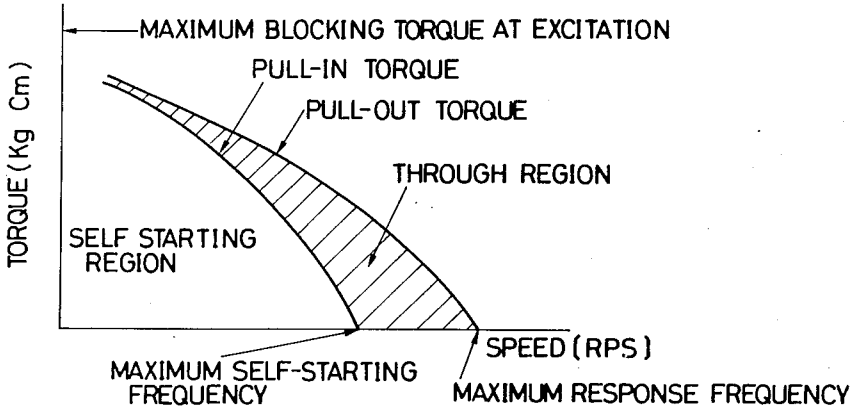
FIG. 26 is a diagram which shows the speed-torque characteristic of the pulse motor.

In bringing the film drive motor 47 to a temporary stop, it is realized instantly without going through a deceleration operation. This is possible because the film drive motor 47, has a smaller speed value (one half) than that of the paper forwarding motor 19, has a smaller inertia of load, and is driven at a frequency in the self-starting region of the pulse motor (see FIG. 26).

Therefore, for a temporary stop of the film drive motor 47 when the paper forwarding motor 19 is operating continuously at a constant speed, there is not required a special deceleration step.

[Control in the Image Data Printing]

Figure 24:
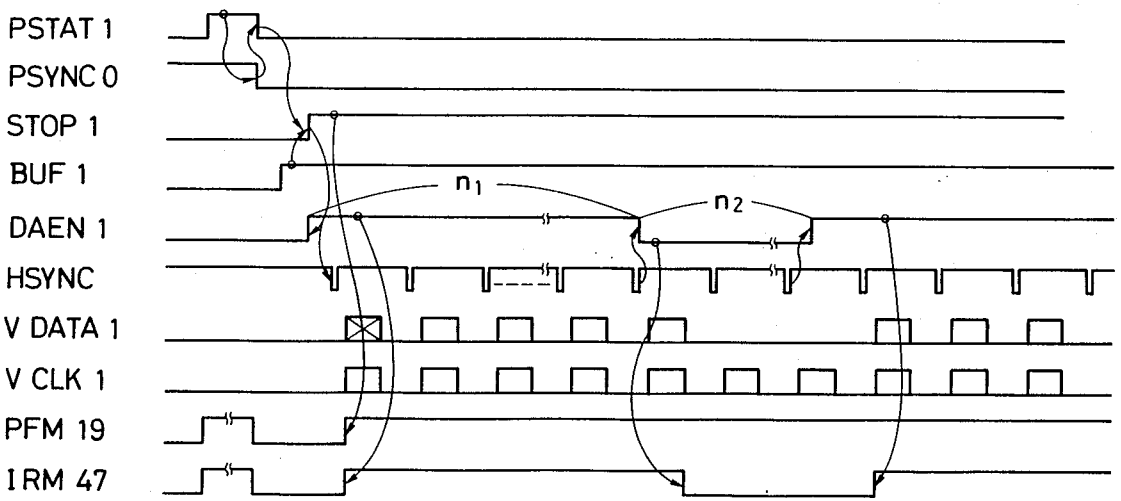
FIG. 24 and FIG. 25 are time charts in the case of image data printing.
Figure 25:
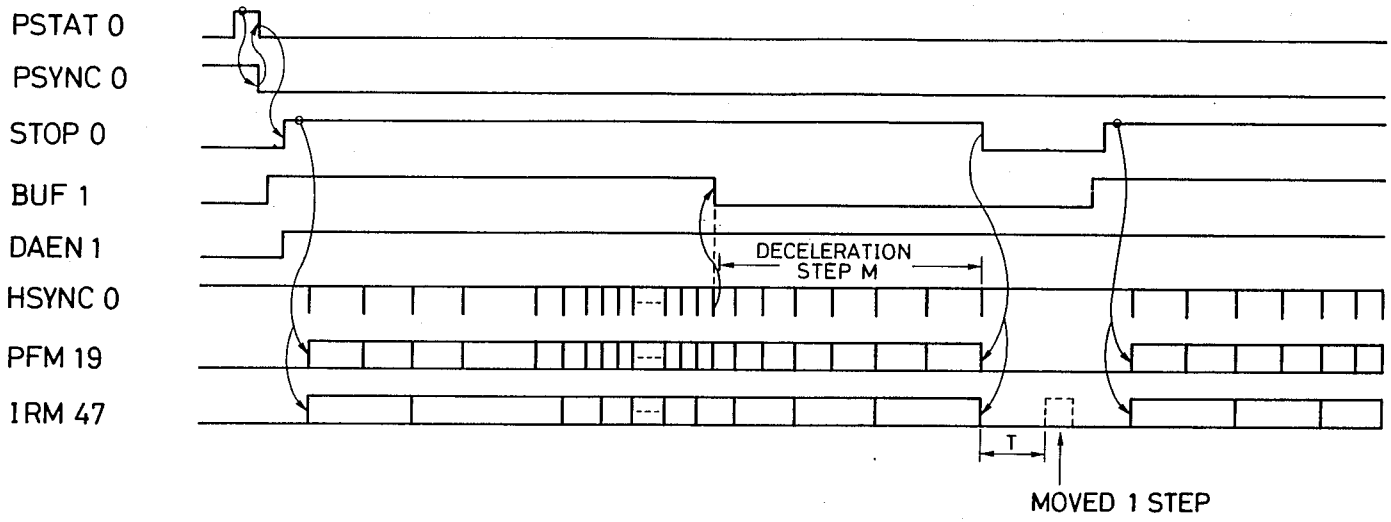

FIG. 24 and FIG. 25 show timing charts in printing an image data.

The paper transportation at the start of printing and the operation of the film drive motor are the same as in FIG. 22. The operation shown in FIG. 24 shows the case of printing an image data. Data are sent out from the image buffers 163 and 165 in FIG. 13 in the order of the image buffer 163 first and the image buffer 165 next. During the time when a first data is sent out from the image buffer 163, there takes place a data transfer from the host-side system 125 to the image buffer 165. In the figure, operational timings are illustrated for the case in which data transfer speed from the host-side system 125 is low such that it cannot catch up with the speed in the other side.

The DAEN1 signal that indicates the effectiveness of the printing is kept in "H" level state all times because the data involved is an image data. And, the STOP0 signal and the BUF1 signal are controlled as follows.

First, since the data transfer to the image buffer 165 is completed during the first sending of the data, the BUF1 signal is shifted to "L" level at a midpoint in the data transfer from the image buffer 163. At this point, on the print control unit 129 side, deceleration step of the paper forwarding motor 19 begins. Accordingly, the paper forwarding motor 19 and the film drive motor 47 that is driven synchronized with the paper forwarding motor 19, are decelerated respectively. Then, by a change to "L" level of the STOP0 signal from the printer interface 127, both drive motors 19 and 47 are brought to stop.

The printing of a second data block is started at the completion of the transfer of data from the host-side system 125 to the image buffer 165. Namely, by the completion of transfer of data to the image buffer 165, the BUF1 signal is changed to "H" level and the STOP0 signal is also changed to "H" level, which releases the temporary halt of the printing operation. The print control unit 129 drives again the paper forwarding motor 19 in the acceleration mode, and carries out printing of the second data block by generating horizontally synchronized signals.

FIG. 25 is an explanatory diagram for showing the timings of impressing the pulses to the paper forwarding motor 19 and the film drive motor 47, in the operation shown in FIG. 24.

The first acceleration timings for block printing is the same as for FIG. 23. A deceleration, after a change to "L" level of the BUF1 signal, is carried out in M steps. The deceleration control for this is carried out also by changing the data set of the timer 199 shown in FIG. 14.

The deceleration for the paper forwarding motor 19 is carried out in steps of M which is the same number as for acceleration. Therefore, the BUF1 signal is controlled so as to be changed to "L" level by the line synchronization signal HSYNC0 which appears M steps prior to the temporary halt. In this control, the printing unit line is set by the printing conditions at that time. Therefore, if the transfer to the next image buffer is completed at the point in time at which there is generated a borrow signal of a data transfer counter (which is counted down by the line synchronization signal HSYNC0) which is not shown and is provided in the printer transfer controller 159 of the printer interface 127, by the counting of the line synchronization signal HSYNC0, the BUF1 signal is set to "L" level. Therefore, the initial value of the counter that is set equals the value which is obtained by subtracting the value of step number M from the number of unit lines.

[Effects of the Invention]

As described in detail in the foregoing, according to the present invention, it is possible to designate a suitable print density in accordance with the print pattern and the size of the member to be recorded by driving the same heating elements for a plural number of times in the same printing line.

Therefore, this apparatus accomplishes a clear recording of the middle density portion and a many valued recording.

Further, in this apparatus, since each of the divided heating elements is driven for the same period by time sharing method, respectively, the density in the divided heating elements is controlled uniformly. This prevents the occurrence of the irregular printing.

Various modifications will become possible for those skilled in the art after receiving the teachings of the present disclosure without departing from the scope thereof.

What is claimed is:

1. A recording apparatus for recording pre-recorded data, said data comprised of printing dots, on a member positioned for recording, wherein each of the printing dots is comprised of a plurality of ink drops, said apparatus comprising:

an ink retaining film having therein multiple orifices containing recording ink, each of the orifices corresponding to one of the plurality of ink drops;

heating means for simultaneously increasing a pressure of said ink contained in a first plurality of said orifices in said film to effect a transfer of ink from the first plurality of the orifices onto said positioned member during data recording for printing said dots, each dot covering a distinct area of the member;

means when activated for moving said ink-retaining film relative said member;

driving means for driving said heating means in accordance with said prerecorded data;

control means when activated for controlling said driving means to repeat the printing of each of said dots on said distinct area of the member during operation of the moving means, for increasing the pressure of the ink in a second plurality of said orifices, wherein the plurality of said ink drops comprising each of said dots is increased; and generating means for generating a plural number of printing control signals for activating said control means.

2. The recording apparatus as claimed in claim 1, wherein:

said heating means comprises a plurality of heating elements each corresponding to one bit of said pre-recorded data;

said driving means includes time sharing driving means for driving a plural number of said heating elements simultaneously in accordance with said pre-recorded data.

3. The recording apparatus as claimed in claim 2, wherein:

said control means comprises a flip-flop circuit for generating an output enable signal to effect recording of data onto said positioned member a plurality of times in accordance with said plural number of printing control signals.

4. The recording apparatus as claimed in claim 1, wherein said plurality of times is two.

5. A recording apparatus for recording pre-recorded data, said data comprised of printing dots, on a member positioned for recording, wherein each of the printing dots is comprised of a plurality of ink drops, said apparatus comprising:

an ink-retaining film having formed therein multiple orifices containing recording ink, each of the orifices corresponding to one of the plurality of ink drops, each of said orifices having a diameter between 10 and 200 micrometers;

heating means for simultaneously heating said ink contained in a first plurality of said orifices in said film to effect a transfer of ink from the first plurality of the orifices onto said positioned member during data recording, for printing said dots, each dot covering a distinct area of the member, said heating means including 1,728 heating elements, each element corresponding to one bit of said pre-recorded data;

driving means for driving said heating elements in accordance with said pre-recorded data;

time sharing means, when activated, for controlling said driving means, driving said heating elements in groups corresponding to 32 bits of data for heating said ink in a different plural number of time sharing means, when activated, for controlling said driving means, driving said heating elements in groups corresponding to 32 bits of data for heating said ink in a second plurality of said orifices to repeat the printing of said dots, wherein the plurality of said ink drops comprising each of said dots is increased; and generating means for generating a plural number of printing control signals for activating said time sharing means.

6. A recording apparatus for recording pre-recorded data, said data comprised of printing dots, on a member positioned for recording wherein each of the printing dots is comprised of a plurality of ink drops, said apparatus comprising:

an ink retaining film having therein multiple orifices containing recording ink, each of the orifices corresponding to one of the plurality of ink drops;

a plurality of heating elements for simultaneously increasing a pressure of said ink contained in a first plurality of said orifices in said film to effect a transfer of ink from the first plurality of the orifices onto said positioned member during data recording, for printing said dots, each dot covering a distinct area of the member;

driving means for driving said heating elements in accordance with said pre-recorded data;

advancing means for advancing said film relative to said heating elements in accordance with said pre-recorded data;

control means when activated for controlling said driving means and said advancing means and for heating said ink in a second plurality of orifices to repeat the printing of the dots, wherein the plurality of said ink drops comprising each of said dots is increased.

7. The recording apparatus as claimed in claim 6, wherein:

said control means includes means for generating a plural number of printing control signals for activating said control means, and a printing data control circuit and a flip-flop circuit for generating an output enable signal to effect recording of data onto said positioned member a plurality of times in accordance with said plural number of printing control signals.

8. The recording apparatus as claimed in claim 7, wherein said plurality of times is two.

9. The recording apparatus as claimed in claim 7, wherein:

said printing data control circuit includes time sharing drive means for driving each of said heating elements for the same duration of time.

* * * * *